US009086199B2

(12) United States Patent
Wang et al.

(10) Patent No.: US 9,086,199 B2
(45) Date of Patent: Jul. 21, 2015

(54) LIGHTING DEVICE INSTALLATION METHOD AND LIGHTING SYSTEM

(71) Applicant: LEOTEK Electronics Corporation, Taoyuan Hsien (TW)

(72) Inventors: Shih-Chang Wang, Taoyuan Hsien (TW); Po-Chang Li, Taoyuan Hsien (TW); Ming-Chun Wu, Taoyuan Hsien (TW); Pin-Hao Hsu, Taoyuan Hsien (TW); Ming-Chih Lai, Taoyuan Hsien (TW)

(73) Assignee: Lite-On Technology Corporation, Taiwan (CN)

( * ) Notice: Subject to any disclaimer, the term of this patent is extended or adjusted under 35 U.S.C. 154(b) by 71 days.

(21) Appl. No.: 14/013,721

(22) Filed: Aug. 29, 2013

(65) Prior Publication Data

US 2015/0062932 A1 Mar. 5, 2015

(51) Int. Cl.
*F21V 21/02* (2006.01)
*F21S 8/00* (2006.01)

(52) U.S. Cl.
CPC .. *F21S 8/036* (2013.01); *F21S 8/03* (2013.01); *F21S 8/033* (2013.01); *F21V 21/02* (2013.01)

(58) Field of Classification Search
CPC ..... F21S 8/00; F21S 8/036; F21S 8/033; F21V 17/00–17/005; F21V 17/08; F21V 17/108; F21V 17/16–17/20
See application file for complete search history.

(56) References Cited

U.S. PATENT DOCUMENTS

| | | | | | |
|---|---|---|---|---|---|
| 2,569,859 | A * | 10/1951 | Locke | 362/220 |
| 2,665,330 | A | 1/1954 | Wong | |
| 3,208,709 | A | 9/1965 | Riegler | |
| 3,560,732 | A * | 2/1971 | Green | 362/451 |
| 4,222,093 | A * | 9/1980 | Garcia et al. | 362/147 |
| 6,135,618 | A * | 10/2000 | Tai | 362/249.01 |
| 6,905,222 | B1 * | 6/2005 | Russello et al. | 362/147 |
| 2009/0020675 | A1 * | 1/2009 | Serizawa et al. | 248/339 |

FOREIGN PATENT DOCUMENTS

FR 703 334 4/1931

OTHER PUBLICATIONS

European Search Report dated Apr. 8, 2015 issued in counterpart application No. 13185743.5-1757.

* cited by examiner

*Primary Examiner* — Mariceli Santiago
(74) *Attorney, Agent, or Firm* — The Farrell Law Firm, P.C.

(57) ABSTRACT

A lighting device installation method includes the following steps. Firstly, a holder including a first stopping structure and a first engaging structure is fixed on an installation surface. Then, a lighting device including a second stopping structure and a third stopping structure is provided. The second stopping structure and the third stopping structure are collaboratively defined as a second engaging structure. Then, the second engaging structure of the lighting device is stopped by the first stopping structure of the holder, so that the lighting device is supported by the lower portion of the holder. Then, electrical connection between the lighting device and a power source is established. Afterwards, the second engaging structure of the lighting device is engaged with the first engaging structure of the holder, so that the lighting device is supported by the upper portion of the holder.

18 Claims, 4 Drawing Sheets

LIGHTING DEVICE INSTALLATION METHOD AND LIGHTING SYSTEM

FIELD OF THE INVENTION

The present invention relates to an installation method, and more particularly to a lighting device installation method.

BACKGROUND OF THE INVENTION

As known, light emitting diodes (LEDs) have advantages such as lower power consumption, long use life, and quick response speed. Consequently, light emitting diodes are widely used in lighting devices. The lighting device with the light emitting diode is also referred as a LED lamp. Recently, with increasing demands on safety, security and decoration of the outdoor environments, a variety of lighting devices have been developed. The lighting devices include for example outdoor path lamps, garage lamps, advertising lamps, and so on. Generally, the lighting device is installed on a wall of a building. Since the installation position of the lighting device is usually very high relative to the ground, it is important to provide a safe method for installing the lighting device.

A conventional method for installing the lighting device is implemented by a single worker. This method will be illustrated as follows. Firstly, a flat work platform (e.g. an upper end of a ladder or an aerial work platform) is used to place a lighting device thereon. In addition, the worker stands on the flat work platform. Then, a holder is fixed on an installation position of a wall. Then, the lighting device is electrically connected with a utility power source through a power wire. After the lighting device is electrically connected with the utility power source, the lighting device is combined with the holder.

Since the lighting device is placed on the flat work platform, the installation position is far from the lighting device. In other word, the power wire for making electrical connection between the lighting device and the utility power source is very long. Under this circumstance, the mechanism for receiving the power wire within the lighting device should be taken into consideration. In other words, the material cost about the power wire is high, and the process of receiving the power wire increases the installation time. Moreover, since the work space of the flat work platform is narrow and the lighting device is placed on the flat work platform, this method is implemented with difficulty.

Another conventional method for installing the lighting device is implemented by two workers. This method will be illustrated as follows. Firstly, a flat work platform (e.g. an aerial work platform) is used to place a lighting device thereon. In addition, the two workers stand on the flat work platform. Then, a holder is fixed on an installation position of a wall. Then, while the lighting device is lifted and supported by one worker, the electrical connection between the lighting device and a utility power source is established by the other worker. That is, the lighting device is electrically connected with the utility power source through a power wire. After the lighting device is electrically connected with the utility power source, the lighting device is combined with the holder.

Since the lighting device is supported by the other worker during the wiring process, the installation position is located near the lighting device. Under this circumstance, the power wire can be easily received within the lighting device. However, since two workers stand on the narrow space of the flat work platform, this method is implemented with difficulty and hazard potential. Moreover, this method is labor-intensive and the labor cost is high.

From the above discussions, the conventional method for installing the lighting device by a single worker is costly, time-consuming, hazardous and difficult; and the conventional method for installing the lighting device by two workers is costly, labor-intensive and difficult. Moreover, after the lighting device is completely installed and the lighting device has been used for a long time, the lighting device needs to be periodically maintained, repaired or even replaced with a new one. Since the process of maintaining the lighting device is reverse to the process of installing the lighting device, some drawbacks similar to the conventional installation method occur. Moreover, the lighting device is usually heavy in weight. If the lighting device drops down to the ground during the installation process, the hazard is very serious. Consequently, a safety measure should be taken during the installation process of the lighting device.

Therefore, there is a need of providing an improved method for installing a lighting device in order to avoid the above drawbacks.

SUMMARY OF THE INVENTION

The present invention provides a lighting device installation method for installing a light device by a single worker.

The present invention also provides a lighting device installation method for installing a light device in a safe and time-saving manner.

The present invention further provides a lighting system that is installed by using the lighting device installation method of the present invention.

An embodiment of the present invention provides a lighting device installation method. Firstly, a holder is fixed on an installation surface. The holder includes a first stopping structure and a first engaging structure. The first stopping structure is located at a lower portion of the holder, and the first engaging structure is located at an upper portion of the holder. Then, a lighting device including a second stopping structure and a third stopping structure is provided. The second stopping structure and the third stopping structure are located at an upper portion of the lighting device, and collaboratively defined as a second engaging structure. Then, the second engaging structure of the lighting device is stopped by the first stopping structure of the holder, so that the lighting device is supported by the lower portion of the holder. Then, electrical connection between the lighting device and a power source is established. Afterwards, the second engaging structure of the lighting device is engaged with the first engaging structure of the holder, so that the lighting device is supported by the upper portion of the holder.

Another embodiment of the present invention provides a lighting system. The lighting system includes a holder, a lighting device, and a power source. The holder is fixed on an installation surface, and includes a first stopping structure and a first engaging structure. The first stopping structure is located at a lower portion of the holder, and the first engaging structure is located at an upper portion of the holder. The lighting device includes a second stopping structure and a third stopping structure. The second stopping structure and the third stopping structure are located at an upper portion of the lighting device, and collaboratively defined as a second engaging structure. The lighting device is electrically connected with the power source. When the second engaging structure of the lighting device is stopped by the first stopping structure of the holder, the lighting device is supported by the lower portion of the holder. When the second engaging structure of the lighting device is engaged with the first engaging structure of the holder, the lighting device is supported by the upper portion of the holder.

A further embodiment of the present invention provides a lighting system. The lighting system includes a holder, a lighting device, and a power source. The holder is fixed on an installation surface, and includes a first stopping structure and a first engaging structure. The first stopping structure is located at a lower portion of the holder, and the first engaging structure is located at an upper portion of the holder. The lighting device includes a second stopping structure and a third stopping structure. The second stopping structure and the third stopping structure are located at an upper portion of the lighting device, and collaboratively defined as a second engaging structure. The lighting device is electrically connected with the power source. Before the lighting device is electrically connected with the power source, the second engaging structure of the lighting device is stopped by the first stopping structure of the holder, so that the lighting device is supported by the lower portion of the holder. After the lighting device is electrically connected with the power source, the second engaging structure of the lighting device is engaged with the first engaging structure of the holder, so that the lighting device is supported by the upper portion of the holder.

Numerous objects, features and advantages of the present invention will be readily apparent upon a reading of the following detailed description of embodiments of the present invention when taken in conjunction with the accompanying drawings. However, the drawings employed herein are for the purpose of descriptions and should not be regarded as limiting.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention provides a lighting device installation method and a lighting system. In accordance with a feature of the present invention, the lighting device installation method is performed by a single worker. Before the lighting device installation method is performed, the worker may stand on a flat plane or an upper end of a ladder near the installation position. If the installation position is very high relative to the ground or the flat plane, after the worker along with the lighting device stands on an aerial work platform, the aerial work platform will be lifted to the installation position.

Hereinafter, the lighting device installation method and the lighting system will be illustrated with reference to FIGS. 1~6.

Figure 1A:
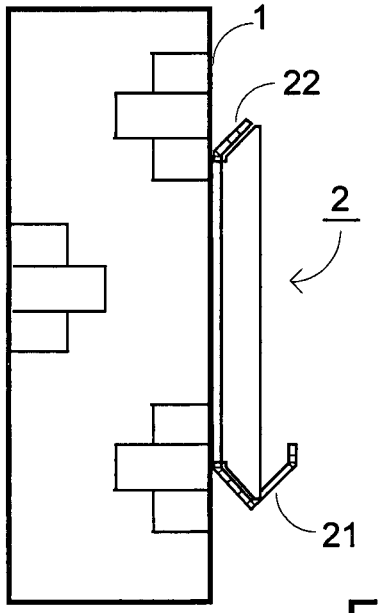
FIG. 1A is a schematic side view illustrating a holder fixed on an installation surface.
Figure 1B:
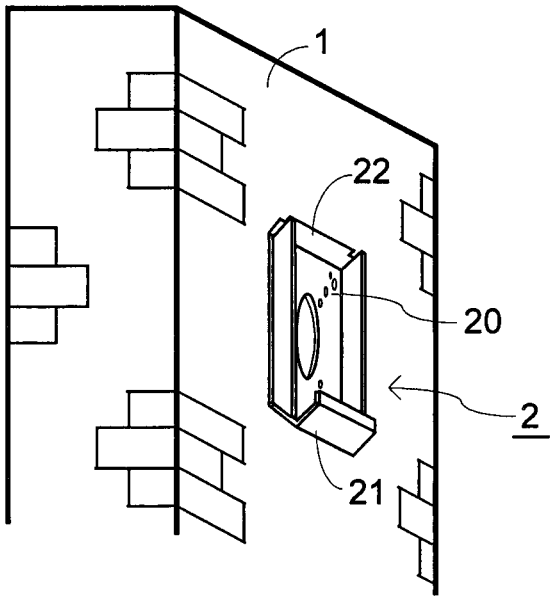
FIG. 1B is a schematic perspective view illustrating the holder and the installation surface as shown in FIG. 1A.

FIG. 1A is a schematic side view illustrating a holder fixed on an installation surface. FIG. 1B is a schematic perspective view illustrating the holder and the installation surface as shown in FIG. 1A. As shown in FIG. 1A and FIG. 1B, a holder 2 is provided and fixed on an installation surface 1. For example, the installation surface 1 is a wall surface. The holder 2 comprises plural fixing holes 20, a first stopping structure 21, and a first engaging structure 22. The first stopping structure 21 is located at a lower portion of the holder 2. The first engaging structure 22 is located at an upper portion of the holder 2. In this embodiment, the first engaging structure 22 is a protruding edge. Moreover, by tightening screws (not shown) into the plural fixing holes 20, the holder 2 is fixed on the installation surface 1. The way of using the screws to fix the holder 2 is presented herein for purpose of illustration and description only. However, those skilled in the art will readily observe that the way of fixing the holder 2 on the installation surface 1 may be varied according to the practical requirements.

Figure 2:
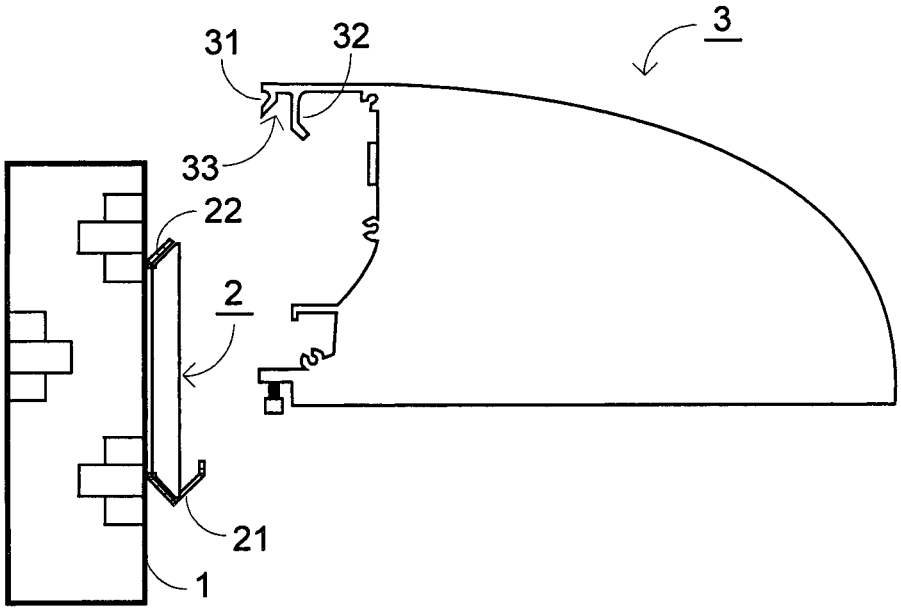
FIG. 2 schematically illustrates the relationship between the lighting device and the holder, in which the upper portion of the lighting device is moved toward the lower portion of the holder.

FIG. 2 schematically illustrates the relationship between the lighting device and the holder, in which the upper portion of the lighting device is moved toward the lower portion of the holder. After the holder 2 is fixed on the installation surface 1, a lighting device 3 is provided. Preferably, the lighting device 3 is a LED lamp. An example of the lighting device 3 includes but is not limited to an outdoor path lamp, a garage lamp or an advertising lamp. For clearly illustrating the detailed structures of the lighting device, the lighting device shown in FIG. 2 and the following drawings will be described by cross-sectional views. In this embodiment, the light-outputting surface of the lighting device 3 is located at a bottom side of the lighting device 3. It is noted that the position of the light-outputting surface of the lighting device 3 is not restricted. For example, in some other embodiments, the light-outputting surface may be located at a top side, a left side or a right side of the lighting device. Please refer to FIG. 2 again. The lighting device 3 comprises a second stopping structure 31 and a third stopping structure 32. Moreover, the second stopping structure 31 and the third stopping structure 32 are collaboratively defined as a second engaging structure 33. In this embodiment, the second engaging structure 33 is a recess. More especially, the profile of the second engaging structure 33 is not restricted as long as the shape of the second engaging structure 33 matches the first engaging structure 22 and first stopping structure 21 of the holder 2.

Figure 3:
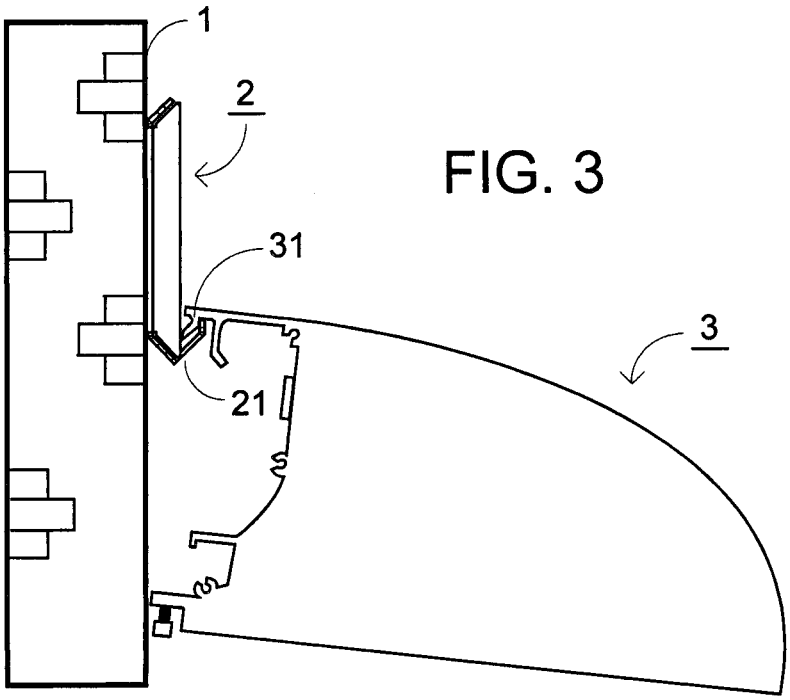
FIG. 3 schematically illustrates the contact between the second stopping structure of the lighting device and the first stopping structure of the holder.

FIG. 3 schematically illustrates the contact between the second stopping structure of the lighting device and the first stopping structure of the holder. Then, as shown in FIG. 3, the second stopping structure 31 of the lighting device 3 and the first stopping structure 21 of the holder 2 are stopped by each other. The first stopping structure 21 of the holder 2 is positioned in the second engaging structure 33 of the lighting device 3. Consequently, the lighting device 3 is supported by the lower portion of the holder 2.

Figure 4:
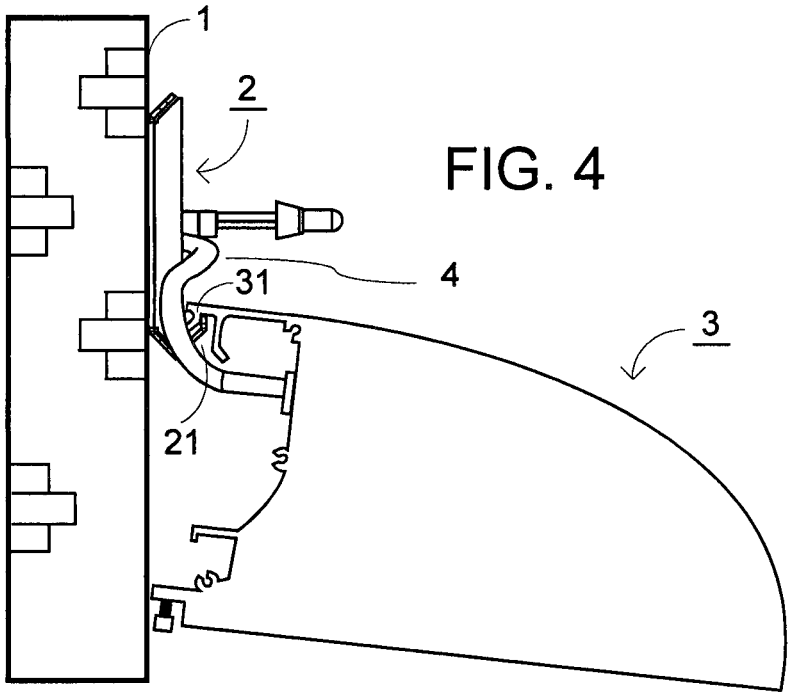
FIG. 4 schematically illustrates the electrical connection between the lighting device and a power source.

FIG. 4 schematically illustrates the electrical connection between the lighting device and a power source. After the lighting device 3 is supported by the lower portion of the holder 2, the lighting device 3 is connected with a power source (not shown) through a power wire 4. For example, the power source is a utility power source. Meanwhile, the electrical connection between the lighting device 3 and the power source is established. It is noted that the width of the lighting device 3 is larger than the width of the holder 2. Consequently, the power wire 4 can be received within a space between the lighting device 3 and the holder 2.

Figure 5:
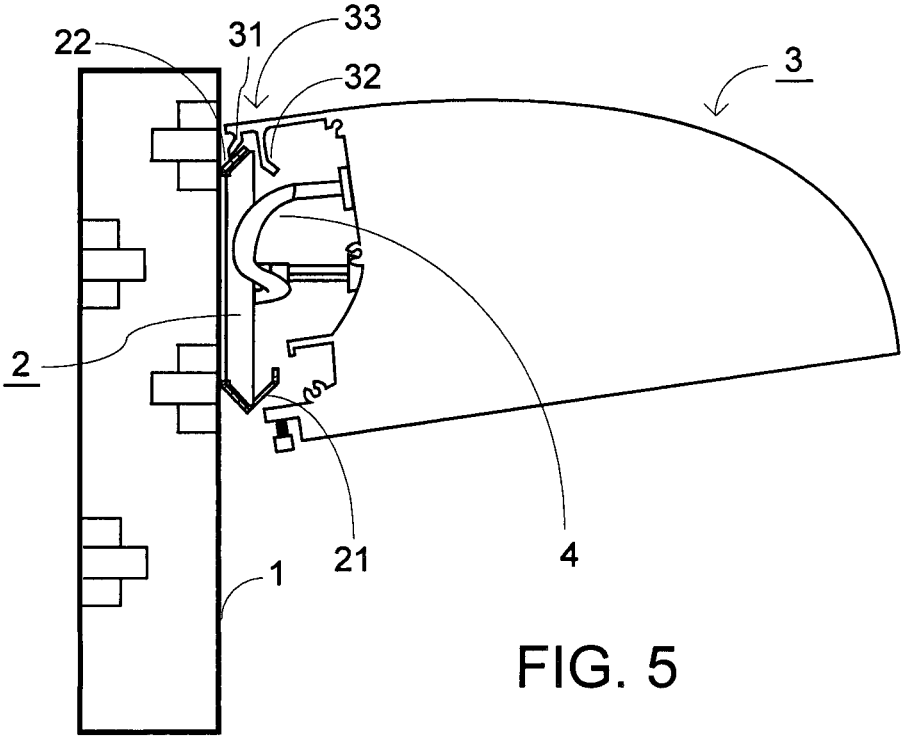
FIG. 5 schematically illustrates the relationship between the lighting device and the holder, in which the upper portion of the lighting device is moved toward the upper portion of the holder.

FIG. 5 schematically illustrates the relationship between the lighting device and the holder, in which the upper portion of the lighting device is moved toward the upper portion of the holder. After the electrical connection between the lighting device 3 and the power source is established, the second stopping structure 31 of the lighting device 3 is detached from the first stopping structure 21 of the holder 2. Consequently, the lighting device 3 is no longer supported by the lower portion of the holder 2. Then, the upper portion of the lighting device 3 is moved toward the upper portion of the holder 2. After the second engaging structure 33 is engaged with the first engaging structure 22, the lighting device 3 is supported by the upper portion of the holder 2.

Figure 6:
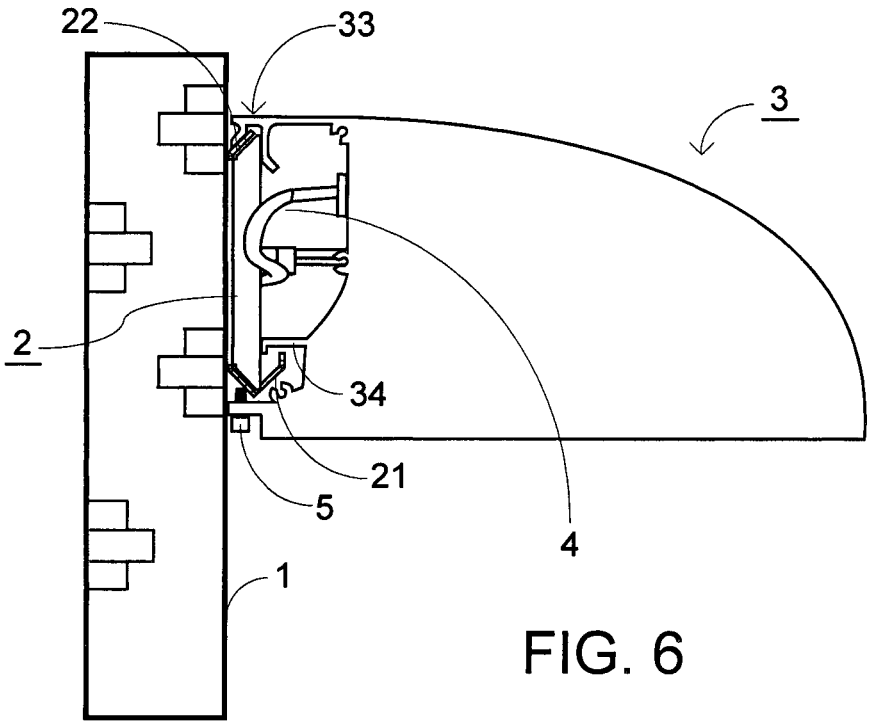
FIG. 6 schematically illustrates the combination of the lighting device and the holder.

FIG. 6 schematically illustrates the combination of the lighting device and the holder. The lighting device 3 further comprises a fourth stopping structure 34. The fourth stopping structure 34 is located near the first stopping structure 21 of the lighting device 3. The fourth stopping structure 34 is engaged with the first stopping structure 21 in case the first engaging structure 22 is detached from the second engaging structure 33. Under this situation, the lighting device 3 will not fall from the installation surface 1. Finally, the lighting device 3 is securely fixed on the holder 2 through a fastening element 5, wherein the fastening element 5 is penetrated through the lighting device 3 and fixed at a lower backside of the holder 2. An example of the fastening element 5 included but is not limited to a screw. Meanwhile, the lighting device 3 and the holder 2 are combined together. In this context, the lighting device 3, the holder 2 and the power source are collaboratively defined as a lighting system.

From the above descriptions, the present invention provides a lighting device installation method and a lighting system. The lighting device installation method can be implemented by a single worker. Consequently, the drawbacks caused by the two workers' installation method will be overcome. In other words, the lighting device installation method of the present invention can be implemented in an easier, safer and more labor-saving manner when compared with the two workers' installation method. Moreover, since the lighting device is supported by the lower portion of the holder before the lighting device is electrically connected with the power source, the length of the power wire can be largely reduced and the possibility of dropping down the lighting device during the installation process will be minimized. In other words, it is not necessary to take the mechanism of receiving the power wire into consideration, and safety of installing the lighting device is enhanced. Consequently, the lighting device installation method of the present invention can be implemented in a cost-effective and time-saving manner when compared with the conventional single worker's installation method.

More especially, after the lighting device has been used for a long time, the lighting device needs to be periodically maintained, repaired or even replaced with a new one. The process of maintaining the lighting device is reverse to the process of installing the lighting device. That is, for maintaining the lighting device, the lighting device is firstly detached from the holder and then supported by the lower portion of the holder. Consequently, the process of maintaining the lighting device also has the above benefits of the lighting device installation method.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures

What is claimed is:

1. A lighting device installation method, comprising steps of:

fixing a holder on an installation surface, wherein the holder comprises a first stopping structure and a first engaging structure, wherein the first stopping structure is located at a lower portion of the holder, and the first engaging structure is located at an upper portion of the holder;

providing a lighting device comprising a second stopping structure and a third stopping structure, wherein the second stopping structure and the third stopping structure are located at an upper portion of the lighting device, and collaboratively defined as a second engaging structure;

allowing the second engaging structure of the lighting device to be stopped by the first stopping structure of the holder, so that the lighting device is supported by the lower portion of the holder;

establishing electrical connection between the lighting device and a power source; and allowing the second engaging structure of the lighting device to be engaged with the first engaging structure of the holder, so that the lighting device is supported by the upper portion of the holder.

2. The lighting device installation method as claimed in claim 1, wherein the lighting device further comprises a fourth stopping structure, and the fourth stopping structure is located near the first stopping structure of the holder, wherein the fourth stopping structure of the lighting device is stopped by the first stopping structure of the holder in case the first engaging structure is detached from the second engaging structure.

3. The lighting device installation method as claimed in claim 2, wherein after the second engaging structure of the lighting device is engaged with the first engaging structure of the holder, the lighting device is securely fixed on the holder through a fastening element, wherein the fastening element is penetrated through the lighting device and fixed at a lower backside of the holder.

4. The lighting device installation method as claimed in claim 1, wherein the first engaging structure is a protruding edge, and the second engaging structure is a recess.

5. The lighting device installation method as claimed in claim 1, wherein the power source is a utility power source, and the lighting device is electrically connected with the utility power source through a power wire.

6. The lighting device installation method as claimed in claim 1, wherein the lighting device is a LED lamp selected from an outdoor path lamp, a garage lamp or an advertising lamp.

7. A lighting system, comprising:

a holder fixed on an installation surface, and comprising a first stopping structure and a first engaging structure, wherein the first stopping structure is located at a lower portion of the holder, and the first engaging structure is located at an upper portion of the holder;

a lighting device comprising a second stopping structure and a third stopping structure, wherein the second stopping structure and the third stopping structure are located at an upper portion of the lighting device, and collaboratively defined as a second engaging structure; and a power source, wherein the lighting device is electrically connected with the power source, wherein when the second engaging structure of the lighting device is stopped by the first stopping structure of the holder, the lighting device is supported by the lower portion of the holder, wherein when the second engaging structure of the lighting device is engaged with the first engaging structure of the holder, the lighting device is supported by the upper portion of the holder.

8. The lighting system as claimed in claim 7, wherein the lighting device further comprises a fourth stopping structure, and the fourth stopping structure is located near the first stopping structure of the holder, wherein the fourth stopping structure of the lighting device is stopped by the first stopping structure of the holder in case the first engaging structure is detached from the second engaging structure.

9. The lighting system as claimed in claim 8, wherein after the second engaging structure of the lighting device is engaged with the first engaging structure of the holder, the lighting device is securely fixed on the holder through a fastening element, wherein the fastening element is penetrated through the lighting device and fixed at a lower backside of the holder.

10. The lighting system as claimed in claim 7, wherein the first engaging structure is a protruding edge, and the second engaging structure is a recess.

11. The lighting system as claimed in claim 7, wherein the power source is a utility power source, and the lighting device further comprises a power wire, wherein the lighting device is electrically connected with the utility power source through the power wire.

12. The lighting system as claimed in claim 7, wherein the lighting device is a LED lamp selected from an outdoor path lamp, a garage lamp or an advertising lamp.

13. A lighting system, comprising:

a holder fixed on an installation surface, and comprising a first stopping structure and a first engaging structure, wherein the first stopping structure is located at a lower portion of the holder, and the first engaging structure is located at an upper portion of the holder;

a lighting device comprising a second stopping structure and a third stopping structure, wherein the second stopping structure and the third stopping structure are located at an upper portion of the lighting device, and collaboratively defined as a second engaging structure; and a power source, wherein the lighting device is electrically connected with the power source, wherein before the lighting device is electrically connected with the power source, the second engaging structure of the lighting device is stopped by the first stopping structure of the holder, so that the lighting device is supported by the lower portion of the holder, wherein after the lighting device is electrically connected with the power source, the second engaging structure of the lighting device is engaged with the first engaging structure of the holder, so that the lighting device is supported by the upper portion of the holder.

14. The lighting system as claimed in claim 13, wherein the lighting device further comprises a fourth stopping structure, and the fourth stopping structure is located near the first stopping structure of the holder, wherein the fourth stopping structure of the lighting device is stopped by the first stopping structure of the holder in case the first engaging structure is detached from the second engaging structure.

15. The lighting system as claimed in claim 14, wherein after the second engaging structure of the lighting device is engaged with the first engaging structure of the holder the lighting device is securely fixed on the holder through a fastening element, wherein the fastening element is penetrated through the lighting device and fixed at a lower backside of the holder.

16. The lighting system as claimed in claim 13, wherein the first engaging structure is a protruding edge, and the second engaging structure is a recess.

17. The lighting system as claimed in claim 13, wherein the power source is a utility power source, and the lighting device further comprises a power wire, wherein the lighting device is electrically connected with the utility power source through the power wire.

18. The lighting system as claimed in claim 13, wherein the lighting device is a LED lamp selected from an outdoor path lamp, a garage lamp or an advertising lamp.

* * * * *